United States Patent [19]

McCole

[11] 4,356,248

[45] Oct. 26, 1982

[54] PHOTOGRAPHIC PRODUCT

[75] Inventor: Thomas P. McCole, South Natick, Mass.

[73] Assignee: Polaroid Corporation, Cambridge, Mass.

[21] Appl. No.: 267,013

[22] Filed: May 26, 1981

[51] Int. Cl.[3] ..... G03C 1/48

[52] U.S. Cl. ..... 430/209; 430/210; 430/497

[58] Field of Search ..... 430/209, 210, 497, 498, 430/499

[56] References Cited

U.S. PATENT DOCUMENTS

| | | | |
|---|---|---|---|
| 2,500,422 | 3/1950 | Land . | |
| 2,627,460 | 2/1953 | Land . | |
| 3,589,904 | 6/1971 | Chen . | |
| 3,607,285 | 9/1971 | Chen . | |
| 3,615,436 | 10/1971 | Campbell . | |
| 3,615,539 | 10/1971 | Land . | |
| 3,615,540 | 10/1971 | Land et al. . | |
| 3,619,193 | 11/1971 | Knight . | |
| 3,621,768 | 11/1971 | Chen . | |
| 3,652,281 | 3/1972 | Bachelder et al. . | |
| 3,652,282 | 3/1972 | Land . | |
| 3,689,269 | 9/1972 | Schieven | 430/209 |
| 3,694,206 | 9/1972 | Downey . | |
| 3,732,101 | 5/1973 | Land et al. . | |
| 3,751,256 | 8/1973 | Harvey | 430/209 |
| 3,761,269 | 9/1973 | Campbell . | |
| 3,816,128 | 6/1974 | Chen . | |
| 4,042,395 | 8/1977 | Tone et al. . | |
| 4,042,396 | 8/1977 | Sylvester | 430/209 |
| 4,242,443 | 12/1980 | Luhrig et al. | 430/209 |
| 4,247,626 | 1/1981 | Poshkus et al. . | |

*Primary Examiner*—J. Travis Brown

*Attorney, Agent, or Firm*—John W. Ericson

[57] ABSTRACT

A photographic film unit of the type comprising two sheets between which a fluid composition is adapted to be spread during processing of a latent image, comprising a fluid trap and gas vent structure for releasing gases expelled from the film unit during the spreading of the processing composition and for receiving excess quantities of the fluid composition, in which a plurality of flow passages are provided in the path of the escaping gas and the advancing fluid composition, and in which a portion of the trap structure comprises a flexible diaphragm forming an expansible chamber having a low impedance to fluid flow relative to the resistance to flow of a plurality of gas vent passages that are provided.

7 Claims, 9 Drawing Figures

PHOTOGRAPHIC PRODUCT

This invention relates to photography, and particularly to a novel film unit of the self-processing type.

Film units of the kind in which a visible image is formed from a latent image by diffusion transfer processes may be characterized as comprising a superposed pair of generally rectangular sheets, at least one of which contains photosensitive constituents. These sheets have leading edges at which a supply of fluid processing composition is disposed, trailing edges at which there is a trap for receiving excess processing composition, and side edges between the leading and trailing edges along which barriers are provided for confining processing composition introduced between the sheets adjacent their leading edges to a path leading to the trailing edges. Currently marketed examples of this type are Time-Zero SX-70 Land film units, as made and sold by Polaroid Corporation of Cambridge, Mass., and Kodak Instant Print Film PR 10-2, as made and sold by Eastman Kodak Company of Rochester, N.Y.

In use, following exposure of such a film unit to produce a latent image in one of the sheets, the film unit is advanced between a pair of processing rollers, which pass from the leading edge to the trailing edge of the film unit. During this process, the pod containing processing composition is ruptured, dispensing the processing composition between the sheets, whereupon the processing composition is advanced between the rollers and forms a desirably uniform coating between the sheets, leaving a somewhat variable residue that is deposited in the trap area. Devising a structure in which this process will be carried out as intended despite expected variations in temperature, pressure, and processing speed, as well as the age of the film unit, presents a challenging problem in fluid dynamics.

The processing compositions in use are highly pigmented and strongly alkaline, so that it is essential to prevent leakage from the film unit. The problem presented in this regard is that, as noted in U.S. Pat. No. 2,500,422, as the processing composition is moved out of the pod, between the film units, and into the trap region, a certain amount of air must be displaced that has to be vented ahead of the processing composition to avoid building up pressure that would tend to force the processing composition back between the sheets after the processing rollers have passed over the film unit. Typical processing compositions are aqueous non-Newtonian fluids of relatively high viscosity which is a function not only of temperature, but of moisture content that can change with aging, and of shear stress. Since the shear stress in the fluid can change abruptly with transitions in the geometry of the passage through which the fluid is being advanced, the behavior of the fluid during the processing of any particular film unit will be quite complex, particularly in the trap region where frequent changes in geometry are encountered as the excess fluid moves into the trap behind a variable mass of air.

To summarize the goals of the manufacturer in addressing the above problems in the construction of satisfactory film units, the desired result is to attain a uniform coverage of processing composition in the picture area without any backflow from the trap into the picture area, accompanied by adequate venting of air from the film unit without leakage of the processing composition.

Numerous approaches to the solution of these problems have been proposed, involving various modifications in the structure of, and relationships between, the several elements of the film unit. In addition to the superposed sheets and the container of processing fluid, these elements generally comprise a mask, which serves to define the picture area, cooperates with the superposed sheets to confine the processing composition at the edges of the sheets, and may perform other functions. There is also a spacer element, which is generally included in the trap region both to limit the approach of the processing rollers toward each other in the trap region during processing, and to serve as a container for the excess processing fluid. Such modifications have been directed toward the attainment of various specific characteristics which tend to minimize the problems encountered during the processing of the film unit.

In particular, in one construction that was satisfactorily employed in Polaroid SX-70 film units as formerly manufactured, air between the sheets was eliminated by temporarily laminating the confronting faces of the sheets together during manufacture. Thus, only the air in the space between the outlet of the pod and the enrance between the sheets, and that initially contained in the trap region, needed to be vented during processing. This was accomplished by the use of unlaminated portions of the mask adjacent to the corners at the trailing end of the film unit. This structure was found satisfactory under most of the conditions encountered in practice, even at relatively high processing speeds in the vicinity of about 6.5 inches per second. Another construction, exemplified by the Kodak PR 10 film unit, provides a relatively constant small volume of air between the superposed sheets by a combination of the use of relatively thick and rigid superposed sheets, together with an intermediate thin mask through which the sheets are laminated on three sides. This structure is intended for use at slower processing speeds, in the neighborhood of 1.3 inches per second.

The difficult problem of providing adequate venting without leakage can be avoided if the volume of the trap is made sufficiently large, as suggested in U.S. Pat. No. 2,627,460. In one specific construction proposed for this purpose, the mask is made in the form of an expansible chamber of considerably larger volume than the spacer element, as described in U.S. Pat. No. 3,621,768. Such constructions tend to inhibit the desirable process of drying out of the residual processing composition following the ejection of the processed print from the camera, and are generally accompanied by additional bulk.

Other constructions have been proposed in which the object is to increase the length of the path traversed by vented gases, and by the following processing composition, on the way to the gas vents. U.S. Pat. No. 3,589,904 shows one such construction, in which staggered embossings on one of the superposed sheets adjacent the corners of the trailing edge of the film unit provide a sinuous path for gas flow. In Kodak PR 10 film units, a similar result is attained by laminating the spacer unit to the trap adjacent the edge first encountered by the processing composition in entering the trap, forming a space behind the trap unit which can only be reached by the processing composition after going around the spacer unit. In this protected region, the overlying mask element is perforated to provide gas vents.

Still other constructions have been proposed in which the vents, wherever located, are made in a manner that is intended to discriminate between the passage of gas and liquid, as by greatly reducing the size of the vent orifices. Such construction is exemplified, for example, in U.S. Pat. Nos. 3,607,285 and 3,816,128, in which the spacer element incorporates very small passages which are placed in registry with similarly small perforations in the mask structure overlying the spacer. As a practical matter, the difference in the impedance to fluid flow between gas and liquid offered by a particular orifice is a question of degree, and perforations so small as to present any substantial impedance to the flow of liquid are also so small as to considerably limit the flow of gasses therethrough within the time span provided during the usual processing operation. Moreover, the highly alkaline processing compositions in use tend to wet the materials employed to confine them, so that the ultimate leakage of any fluid through a vent passage that is encountered in its path will be expedited through capillary action, regardless of the size of the perforations so long as they are of greater than molecular dimensions. Thus, the proliferation of very small passages necessary to achieve adequate gas venting capacity simply increases the area over which leakage can occur.

The object of this invention is to facilitate the venting of a self-processing film unit without any appreciable risk of processing composition leakage under a wide variety of conditions of use, and in the presence of variable quantities of gases requiring venting. Briefly, the above and other objects of the invention are attained by a film unit construction in which a trap is provided in the form of a perforated spacer element enclosed in an envelope formed by a portion of the mask, which envelope is perforated in selected regions along its periphery. The spacer element is laminated to the mask only along one edge adjacent the vented region, so that passages into which processing composition can flow are provided through, in front of, behind and at the end of the spacer element first encountered by the processing composition, which passages can be reached in parallel paths from the path of emergence of the processing composition between the superimposed sheets of the film unit. Being attached to the spacer in only a restricted region adjacent the point of attachment of the mask to one of the superposed sheets, the portion of the mask overlying the spacer is free to act as a flexible diaphragm that allows movements of liquid processing composition and gasses within the trap enclosure without any appreciable resistance, and without requiring a trap volume substantially in excess of the volume of the spacer element.

The manner in which a film unit in accordance with an invention is constructed, and its mode of operation, will best be understood in the light of the following detailed description, together with the accompanying drawings, illustrative of the invention.

Figure 1:
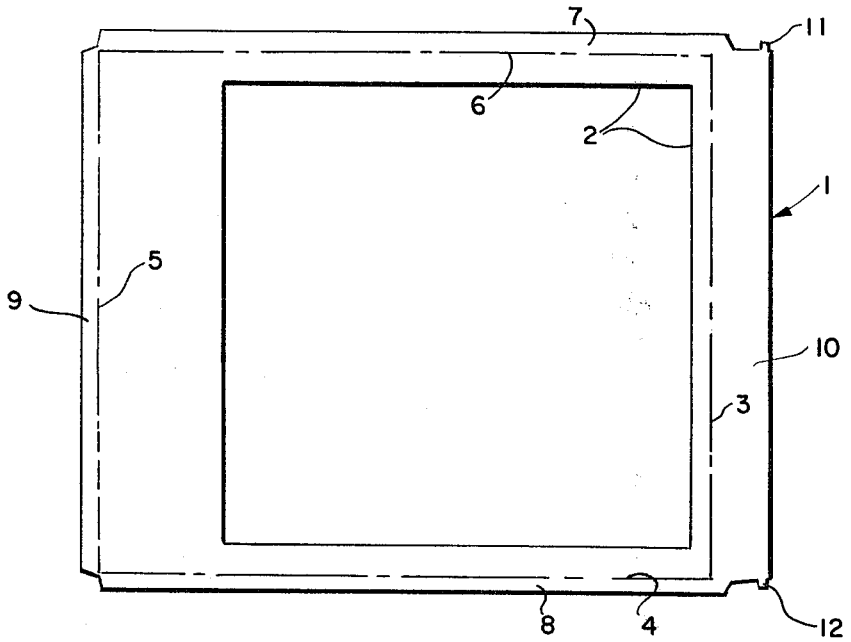
FIG. 1 is a schematic elevational view of a mask suitable for use in a film unit in accordance with the invention.

While the invention can be practiced by suitable modification of any of the conventional self-processing film units known to the art, for clarity of illustration it will be exemplified as applied to a film unit that is basically of the type exemplified by the Polaroid Time-Zero Land film units, and which may be manufactured as described in U.S. Application Ser. No. 141,367, filed on Apr. 18, 1980 by Thomas P. McCole for Photographic Product and Proces of Making the Same, and assigned to the assignee of this invention. Such a film unit comprises a mask 1, as shown in FIG. 1, of any suitable conventional material such as that described in above cited U.S. Application Ser. No. 141,367. As more fully described, the mask material may comprise a substrate of liquid impermeable aluminized polyester or the like, pigmented on one side to provide an attractive border for the film unit, and coated on the other side with a suitable adhesive, such as poly (ethylene/vinyl acetate), to facilitate sealing to the other structures during manufacture. Typically, such a material will be quite thin, for example, from 1.5 to 2 mils in thickness.

The mask is formed with a generally rectangular aperture 2 which serves to define the viewable picture area in the finished print.

During manufacture, the mask is adapted to be folded where indicated by the dotted lines 3, 4, 5, and 6. Regions beyond the fold lines 3, 4, 5, and 6 comprise side panels 7 and 8 which are adapted to be folded around the edges of the rectangular sheets comprising the major components of the film unit during manufacture.

A panel 9 at the leading edge of the mask is adapted to be secured to a pod as described below. A somewhat larger panel 10 at the end of the mask is adapted to be folded around a spacer element to be described, and about the superposed sheets, to define a trap region in a manner to appear.

A pair of projecting tabs 11 and 12 are formed at the ends of the panel 10 which serve to perform functions to be described below. The corners of the panel 10 at which the tabs 11 and 12 are formed are somewhat asymmetrically shaped as suggested in the drawings, a feature preferably incorporated to accomodate for slight dissimilarities in conditions at the opposite sides of the film unit encountered during processing and arising from the fact that the film unit is advanced to the processing rolls by a mechanism which engages only one edge of the film unit. Since these and other matters of detail in the construction of the conventional film unit do not form a part of the invention, per se, they will not be dwelt upon in detail.

Figure 2:
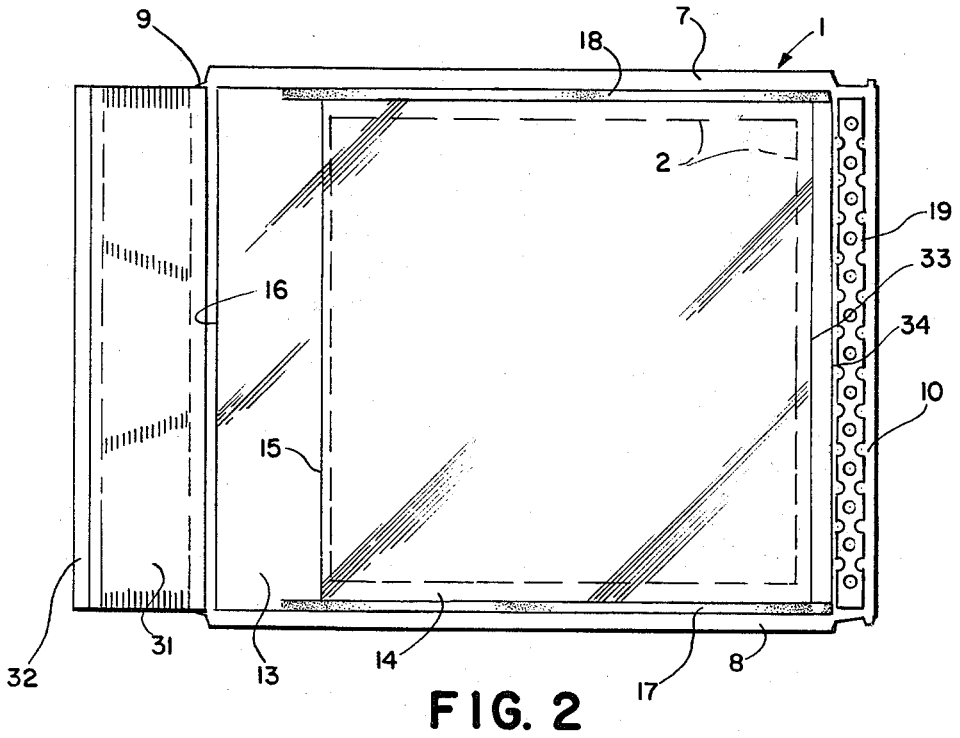
FIG. 2 is a schematic elevational view of the mask of FIG. 1, together with additional components added during the course of the manufacture of a film unit in accordance with the invention.

Referring next to FIG. 2, and as more fully described in the above cited U.S. Application Ser. No. 141,367, during the course of manufacture of the film unit a pod 31 containing processing composition has one edge laminated to the end panel 9 formed at the leading edge of the mask 1. The pod 31 has a tape 32 laminated to its opposite edge, which serves to secure the pod in a later stage of manufacture to be described.

A pair of superposed sheets are disposed on the mask 1, comprising a first sheet 13 immediately adjacent and adhered to the mask 1, and a superposed sheet 14 having two side edges in registry with the corresponding side edges of the sheet 13, a leading edge 15 which is spaced from the leading edge 16 of the sheet 13 by an amount sufficient to allow the placement of the pod 11 between the two sheets, and a trailing edge 33 that is spaced from the trailing edge 34 of the sheet 14.

The sheet 14 may contain a three color negative structure and the sheet 13 may contain an image mordanting layer for receiving a finished image, in a manner known in the art. Alternative constructions, in which various components of the image forming assembly are disposed all on one, or some on one and some on the other, of the sheets 13 and 14, are known in the art and may be employed, if so desired, without departing from the scope of the invention.

In the illustrated embodiment, the sheets 13 and 14 are secured together at the corners by a pair of binder rails 17 and 18. The rails 17 and 18 are adhered to the side edges of the top upper side of the sheet 14 and have ends extending and adhered to confronting faces of the sheet 13 in a manner more fully described in the above cited U.S. Application Ser. No. 141,367. The rails 17 and 18 may typically be about 1/16 inch wide and from 1 to 1.5 mils in thickness. In addition to maintaining the sheets 13 and 14 in registry during manufacture, these rails 17 and 18 may perform other functions described in the above cited application Ser. No. 141,367, such as spacing the processing rollers to allow for an adequate coating of processing composition between the sheets 13 and 14.

A spacer 19 is placed on the end panel 10 and there adhered. In the Polaroid SX-70 film unit construction formerly employed, the spacer 19 was laminated to the panel 10 of the mask 1 in four spaced locations along the left side of the spacer as seen in FIG. 2, which together formed the spacer and adjacent panel 10 into a relatively stiff beam encountered as a fixed barrier in the path of processing fluid advanced by the rollers. In accordance with the invention, the spacer is differently laminated to the mask panel 10 in a manner to be described below.

Figure 3:
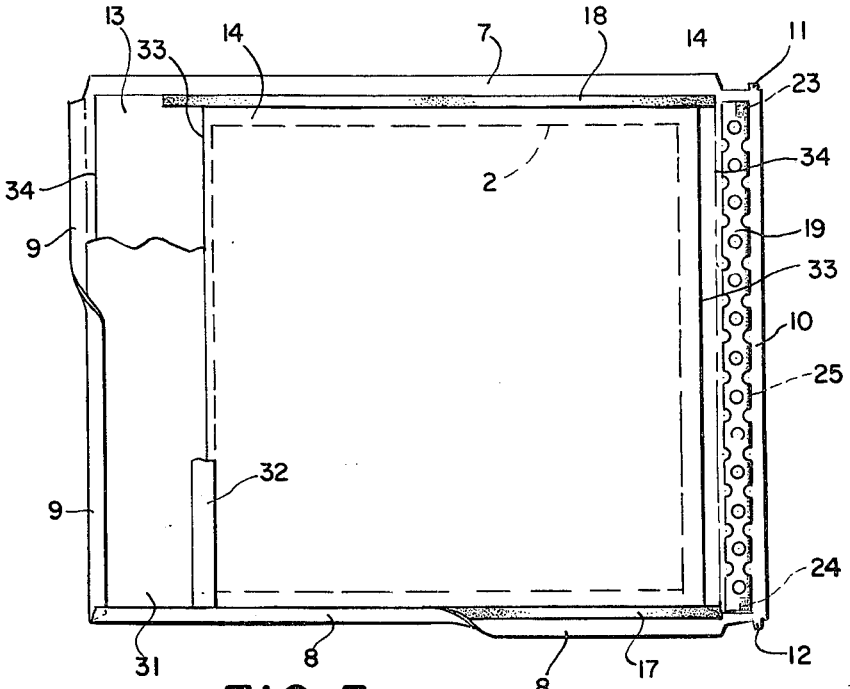
FIG. 3 is a plan view of the structure of FIG. 2, with parts shown folded over and parts broken away, illustrating further steps in the assembly of a film unit in accordance with the invention.

As partially shown in FIG. 3, during further steps of manufacture, the pod 31 is folded around over the sheet 13, and the tape 32 is adhered to the upper edge of the sheet 14 to form a bridge between the rupturable end of the pod 31 and the sheet 14. As partially shown for the panel 8, the panels such as 7 and 8 of the mask 1 are subsequently folded over to overlap the panel 9 at the corners of the leading edge of the film unit.

Figure 4:
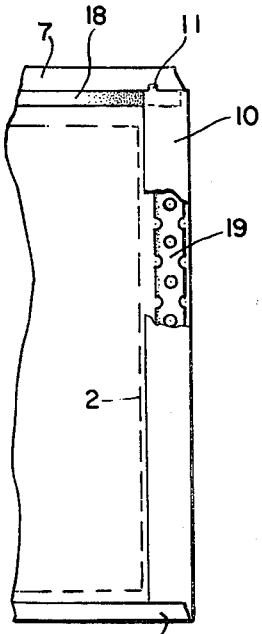
FIG. 4 is a fragmentary plan sketch, with parts broken away, illustrating further steps in the manufacture of a film unit suitable for use in the practice of the invention.
Figure 6:
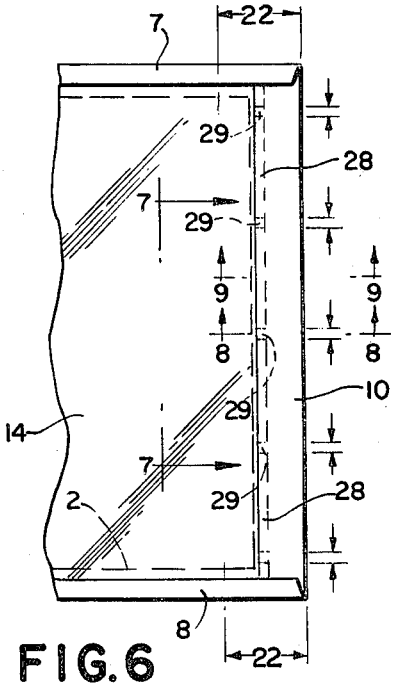
FIG. 6 is a fragmentary plan sketch, similar to FIG. 4, except showing the film unit in accordance with the invention in its completed form.

Comparing FIGS. 3 and 4, the panel 10 is folded over the upper sheet 14, so that the spacer 19 carried with the flap 10 overlaps the edge 33 of the sheet 14. The spacer 19 thus lies partly on the sheet 14 and partly on the underlying sheet 13. Panels 7 and 8 are then folded over to overlap the ends of the panel 10, during which process the tabs such as 11 and 12 are folded over upon themselves onto the panel 10 to form raised portions that serve to separate the processing rollers somewhat during processing, and also to somewhat enlarge passages left for venting purposes by laminating the panels 7 and 8 only partially to the underlying structure. Referring to FIG. 6, in practice, the regions indicated by the arrows 22 at the ends of the panels 7 and 8 are left unlaminated. In this manner, the vents conventionally employed in the former Polaroid SX-70 film units, and also preferably included in the structure of the invention, are provided for.

The spacer 19 may be of conventional construction, for example, preferably formed of a fibrous, liquid absorbent paper board approximately 13 mils in thickness and having apertures formed therein to constitute approximately 15–25% of the volume occupied by the rectangular outline of the spacer 19. A preferred material for this purpose is more fully described in U.S. Pat. No. 3,761,269, which is hereby incorporated herein, by reference, in its entirety. As described in U.S. Pat. No. 3,761,269, the spacer 19 is preferably coated on one side with an acid, such as citric acid, to aid in neutralizing excess processing composition.

Figure 5:
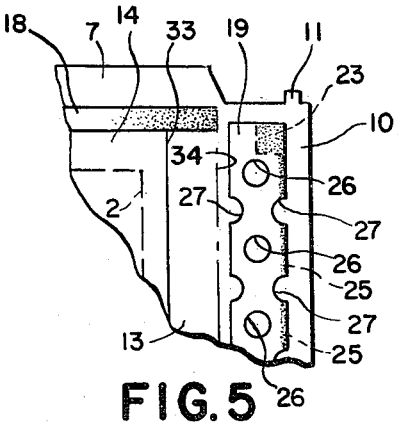
FIG. 5 is a fragmentary schematic elevational sketch, on an enlarged scale, showing further details of the structure of a film unit in accordance with the invention.

As best shown in FIGS. 3 and 4, in accordance with the invention the spacer 19 is selectively laminated to the panel 10 in regions 23 and 24 indicated by the stippled squares in FIGS. 3 and 5 at the ends of the spacer 19 only, and along the right hand edges of the spacer 19 as seen in FIGS. 3 and 5. Intermediate the ends of the spacer 19, the spacer is laminated to the panel 10 only along the outer edges as indicated by the stippled regions 25 in FIGS. 3 and 5. If the width of the spacer 19 is 0.140 inches, the width of the laminated regions 25 should be about 0.03 inches. The body of the spacer intermediate the laminated regions is thus free of the panel 10 and allows the panel 10 to flex as a compliant diaphragm in a manner to be described below.

As a particular example, with sheets 13 and 14 3.474 inches wide and the overlap between the edges 33 and 34 equal to 0.12 inches, the width of the trap panel 10 may be 0.265 inches, the length and width of the spacer 19 3.424 and 0.140 inches, respectively, and the holes 26 of diameter 0.0625 inches spaced on 0.26–0.25 inch centers in rows 0.07 inches apart.

In the manufacture of the spacers 19, the location of the apertures such as 26 in the spacer is controlled laterally of the film unit but not necessarily longitudinally thereof. In other words, complete apertures such as 26 shown in FIGS. 3 and 5 as occuring along a line through the center lengthwise of the spacer 19, could be on either side of this line, whereas the partial apertures such as 27 left at the sides of the spacer when it is cut away from the stock from which it is formed may be more or less symmetrically disposed on the opposite sides of the spacer.

Figure 7:
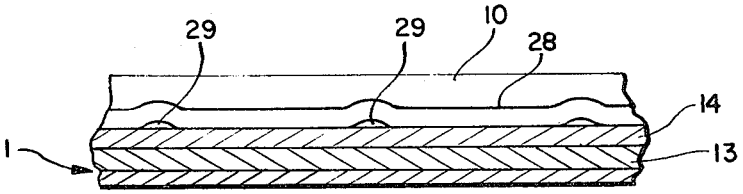
FIG. 7 is a diagrammatic elevational sketch, with parts broken away and parts shown in cross-section, of a portion of the film unit of FIG. 6 on an enlarged scale as seen substantially along the lines 7—7 in FIG. 6.

In accordance with the invention, the outer edge 28 of the panel 10 is laminated to the surface of the upper sheet 14 only in selected regions along the length of the panel, a series of spaced regions 29 being left unlaminated by suitably relieving the platens used in heat sealing the panel 10 to the sheet 14, to allow for venting of air. The portions so unlaminated are indicated in the spaces between the arrows as shown in FIG. 6. Vent passages 29 so formed in the leading edge of the panel 10 are shown greatly exaggerated in FIG. 7. A photomicrograph of this structure would show the edge 28 of the panel 10 in contact with the sheet 14 throughout its length.

Figure 8:
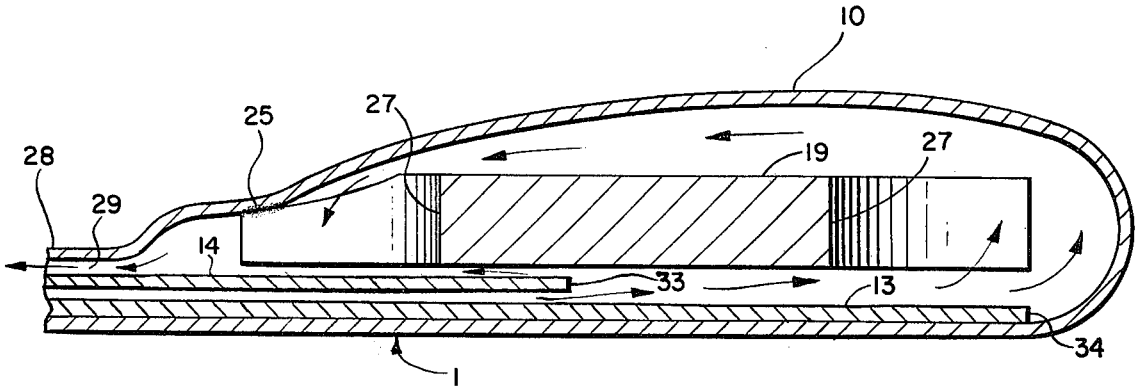
FIG. 8 is a fragmentary elevational sketch, with parts shown in cross-section, and on an enlarged scale, of a portion of the structure of FIG. 6 as seen essentially along the lines 8—8 in FIG. 6.
Figure 9:
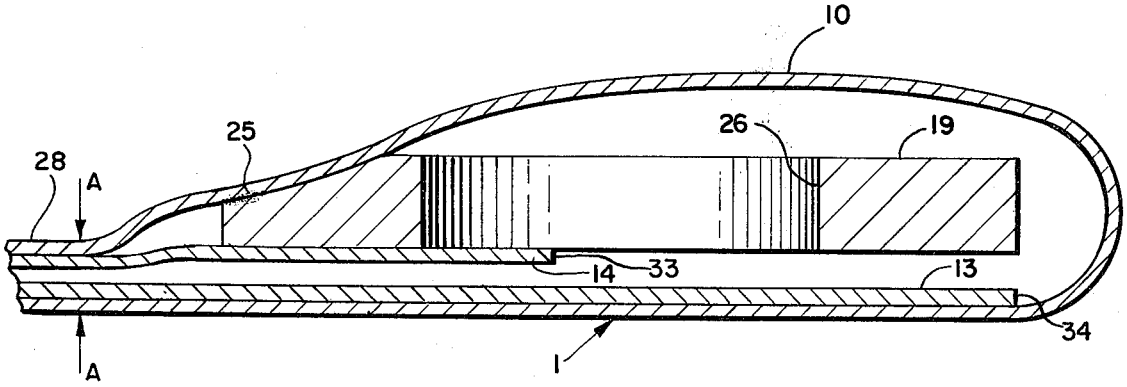
FIG. 9 is a schematic elevational cross-sectional sketch, similar to FIG. 8 but showing another portion of the structure of FIG. 6 as seen along the lines 9—9 in FIG. 6.

FIGS. 8 and 9 are highly diagrammatic functional views illustrating portions of the trap region of the film unit just described in a manner serving to illustrate some of the possibilities that may arise during the processing of the film unit. In particular, in FIG. 8, structures are shown contiguous only if they are physically secured together, and are shown spaced where there is no structural interconnection to imply the possibility that the structures may be separated, as shown, either by gas pressure, or by the pressure of processing composition as it is introduced into the trap region. In FIG. 9, some of the elements are shown contiguous in a relationship which they may assume by reason of pressures exerted upon them.

In particular, referring to FIG. 8, which shows a section through the trap region in which there is an unlaminated portion 29 of the edge 28 of the mask panel 10, prior to processing, and during processing at times during which the processing composition has not yet reached the trap region, or after the passage of the processing rollers, gases may flow in any of the paths suggested by the arrows, between the sheets 13 and 14, behind the spacer 19, through the ports 26 and 27 formed in the spacer 19 in any direction, and out through the unlaminated portion 29 of the edge 28 of the mask 10. Referring to FIG. 9, during processing, as when the processing rollers have advanced towards the trailing edge to the point illustrated by the arrows A—A in FIG. 9, the bulk of the residual processing fluid will have passed ahead of the rollers into the trap region, and portions of the processing composition between the sheets 13 and 14 will tend to separate these sheets and tend to urge the sheet 14 into engagement with the lower side of the spacer 19. At the same time, processing rollers in the vicinity of the arrows A—A will engage the edge 28 of the panel 10, and whether or not the edge 28 is laminated to the edge 14 at this point, will tend to close to prevent egress of any gas, air or liquid from the trap region at this time. As the rollers advance to the right of the position illustrated by the arrows A—A in FIG. 9, all of the trap structure will tend to be compressed together, with the panel 10 being brought down against the spacer 19 and the latter being brought down into engagement with the sheet 13 except as that is prevented by intermediate processing composition, so that the ultimate approach of the rollers together will be limited primarily by the dimensions of the spacer 19 and of the sheets 13 and the surrounding portions of the mask 1. The sheet 13 is typically approximately 4 mils in thickness and the sheet 14 approximately 5 mils in thickness. The spacer 19 is typically several times these dimensions, for example, 13 mils as described above, whereas the sheet 10 is considerably thinner, for example 1.5 to 2 mils in thickness. During this compression process and the subsequent release of the film unit from the rollers, accommodations in the dimensions of the trap region because of movements of the fluid processing composition within it are readily accommodated by compliant movements of the relatively unconstrained panel 10, which serves as a diaphragm to allow such movements with minimum impedance to flow.

While the invention has been described with illustrative reference to the details of specific embodiments, many changes and variations will be apparent to those skilled in the art upon reading this description, and such can obviously be made without departing from the scope of the invention.

Having thus described the invention, what is claimed is:

1. A photographic film unit, comprising first and second generally rectangular superposed sheets of equal widths and unequal lengths, at least one of said sheets comprising photosensitive constituents, a rupturable pod of fluid processing composition disposed on a leading edge of the longer of said sheets confronting a leading edge of the shorter sheet, said longer sheet terminating in a trailing edge protruding beyond a corresponding trailing edge of the shorter sheet, a panel of flexible liquid impermeable material having a first edge adhered to the trailing edge of said longer sheet and extending over to an opposite second edge adherent to said shorter sheet in spaced regions leaving a plurality of nonadhering regions forming gas vents, a perforated spacer element located in a trap region between the trailing edges of said sheets and confined by said flexible panel, said spacer element being secured to said panel only along one edge confronting said second edge of said panel and being free of other attachment to said panel and said sheets, whereby a major portion of said panel between said first and second edges of said panel is free to flex in compliance with pressures exerted by gases and fluid processing composition emerging from between the trailing edges of said sheets to accommodate the free flow of said gases and processing composition around said spacer element and through the perforations thereof in parallel paths to said nonadhering regions of said second edge of said panel.

2. In a film unit of the type adapted to be processed by squeezing a supply of fluid processing composition between a pair of superposed sheets from leading edges to trailing edges thereof, a trap structure adjacent the trailing edges of said sheets for receiving excess fluid composition emerging from between the trailing edges of said sheets, said trap structure comprising a flexible sheet of liquid impermeable material extending around the trailing edges of said sheets to form a trap pocket, said flexible sheet being sealed to one of said sheets along a first edge and having an opposite second edge sealed to the other of said sheets in spaced regions with unsealed intermediate regions forming gas vents, and a generally rectangular elongated spacer located within said pocket, said spacer being formed of liquid absorbent material and provided with a plurality of perforations to serve as wells for receiving excess processing fluid, said spacer element being adhered to said flexible sheet along one edge of said spacer adjacent said second edge of said flexible sheet and being free of other attachment to said flexible sheet intermediate the ends of said spacer to allow movement of said flexible sheet relative to said spacer in compliance with pressures exerted by gases and liquids entering said pocket to facilitate movement of said gases and liquids behind and through the perforations of said spacer in parallel paths to said gas vents.

3. The film unit of claim 1, further comprising means forming additional gas vents along the sides of said superposed sheets adjacent their trailing edges.

4. The film unit of claim 2, further comprising means forming additional gas vents along the sides of said superposed sheets adjacent their trailing edges.

5. A photographic film unit comprising a pair of generally rectangular superposed sheets of equal widths and unequal lengths with the longer sheet protruding beyond the shorter sheet at leading and trailing edges of said sheets, a rupturable pod of fluid processing composition disposed on the leading edge of said longer sheet confronting the leading edge of said shorter sheet, a mask of flexible liquid impermeable material secured to the sides of said sheets between their leading and trailing edges and forming a trap pocket around the trailing edges of said sheets, and a generally rectangular strip of liquid permeable material perforated with a plurality of apertures located in said pocket, overlapping the trailing edges of said sheets, and having one edge secured to said mask on a side located above said shorter sheet, said strip being free of other attachment to said mask intermediate the ends of said strip, whereby regions of said mask in said pocket first encountered by liquids and gases emerging from between the trailing edges of said sheets are relatively free to flex as a compliant diaphragm in response to pressures exerted by said emerging liquids and gases to facilitate flow of said liquids and gases around and through the perforations of said strip.

6. In a self-processing film unit of the type comprising first and second superposed sheets adapted to be processed by the spreading of a layer of processing composition between the sheets from leading to trailing edges therefrom, during which process an excess of processing composition flows out between the trailing edges of the sheets, in which the trailing edge of said first sheet protrudes beyond the trailing edge of said second sheet, a trap structure adjacent the trailing edges of said sheets for receiving said excess processing composition and venting air advanced ahead of said excess processing composition, said trap structure comprising a flexible panel of thin liquid impermeable sheet material having a first edge sealed to the trailing edge of said first sheet and being wrapped around the trailing edge of said second sheet to a second edge of said panel partially sealed to said second sheet to form a plurablity of gas vents facing the leading edge of said first sheet, a perforated spacer element located within said panel and overlying portions of the trailing edges of both of said sheets, said spacer element being hinged to said panel by points of attachment only along one edge of said spacer element confronting said second edge of said panel and being free to move relative to portions of said panel toward said first edge of said panel, whereby said panel is free to flex as a compliant diaphragm in the path of air and processing composition moving out between the trailing edges of said sheets to allow flow around and through the perforations of said spacer element in parallel paths upstream of said points of attachment in direction of fluid flow from the trailing edges of said sheets to said gas vents.

7. In a self-processing film unit of the type comprising a pair of superposed sheets between which processing fluid is adapted to be spread from leading edges to trailing edges of the sheets with an excess of processing fluid emerging from between the trailing edges of the sheets, in which the trailing edges of a first of said sheets protrudes beyond the trailing edge of the second of said sheets, a trap structure comprising a thin flexible sheet of liquid impermeable material extending along the trailing edges of said sheets and having first and second opposed edges secured adjacent the trailing edges of said first and second sheets, respectively, to form a pocket for receiving said excess processing fluid, said second edge of said flexible sheet being secured to said second sheet on a side thereof opposite the side confronting said first sheet by a spaced, series of laminations of said second edge of said flexible sheet to said second sheet along a line between the trailing edge of said second sheet and the leading edge of said second sheet, said spaced series of laminations being interspersed by spaced unlaminated regions providing gas vents, an elongated perforated generally rectangular spacer located in said pocket and overlapping the trailing edges of said first and second sheets, said spacer being laminated to said flexible sheet only along one edge of said spacer overlying said second sheet and adjacent said second edge of said flexible sheet, said spacer being free of attachment to said first and second sheets and free of other attachment to said flexible sheet, whereby said spacer is hinged to said flexible element along an edge downstream in the paths of fluid flowing out from between the trailing edges of said first and second sheets and toward said second edge of said flexible sheet, with portions of said flexible element upstream in said paths and downstream of said first edge of said flexible sheet being relatively free to flex as a compliant diaphragm to accommodate movement of fluids into, through and around said spacer.

* * * * *